US008360268B2

(12) United States Patent
Ullrich

(10) Patent No.: US 8,360,268 B2
(45) Date of Patent: Jan. 29, 2013

(54) CASE OR BAG HAVING A LID ELEMENT THAT CAN BE OPENED WITH ONE HAND

(76) Inventor: Thomas Martin Ullrich, Wörrstadt (DE)

( * ) Notice: Subject to any disclaimer, the term of this patent is extended or adjusted under 35 U.S.C. 154(b) by 1219 days.

(21) Appl. No.: 11/840,258

(22) Filed: Aug. 17, 2007

(65) Prior Publication Data

US 2008/0000741 A1 Jan. 3, 2008

Related U.S. Application Data

(63) Continuation of application No. PCT/EP2006/001141, filed on Feb. 9, 2006.

(30) Foreign Application Priority Data

Feb. 17, 2005 (DE) ..... 10 2005 007 498

(51) Int. Cl.
*B65D 43/14* (2006.01)

(52) U.S. Cl. ..... 220/815; 220/811; 206/214

(58) Field of Classification Search ..... 220/350, 220/254.9, 815, 810–812; 312/322–323, 312/304–307, 312, 295, 350; 206/214
See application file for complete search history.

(56) References Cited

U.S. PATENT DOCUMENTS

| | | | | | |
|---|---|---|---|---|---|
| 1,000,179 | A | * | 8/1911 | Kamenstein | 220/252 |
| 1,029,321 | A | * | 6/1912 | Schaffer | 220/252 |
| 3,159,441 | A | | 12/1964 | Simka | |
| 3,539,239 | A | * | 11/1970 | Mallonn | 312/307 |
| 4,735,309 | A | * | 4/1988 | Nemeth | 206/309 |
| 5,083,847 | A | * | 1/1992 | Peters | 312/322 |
| 5,671,830 | A | * | 9/1997 | Wood | 190/101 |
| 7,086,511 | B2 | | 8/2006 | Morszeck et al. | |

FOREIGN PATENT DOCUMENTS

| | | | |
|---|---|---|---|
| EP | 1059046 | A1 | 12/2000 |
| GB | 191200427 | A1 | 1/1913 |
| WO | 03/007748 | A1 | 1/2003 |

* cited by examiner

*Primary Examiner* — J. Gregory Pickett
*Assistant Examiner* — Blaine Neway
(74) *Attorney, Agent, or Firm* — Laurence A. Greenberg; Werner H. Stemer; Ralph E. Locher

(57) ABSTRACT

A case or bag for holding items has a basic body that is defined by wall elements and a floor element. The basic body has opening that can be closed by a lid element that is disposed on the basic body and can be moved out of an open position into a closed position. The lid element is configured in one piece and with inherent rigidity and can be moved out of its closed position into the open position by interacting guide elements disposed on the basic body and on the lid element through a combined pivoting and displacing movement.

19 Claims, 9 Drawing Sheets

CASE OR BAG HAVING A LID ELEMENT THAT CAN BE OPENED WITH ONE HAND

CROSS-REFERENCED TO RELATED APPLICATIONS

This is a continuation, under 35 U.S.C. §120, of copending international application PCT/EP2006/001141, filed Feb. 9, 2006, which designated the United States; this application also claims the priority, under 35 U.S.C. §119, of German patent application DE 10 2005 007 498.7, filed Feb. 17, 2005; the prior applications are herewith incorporated by reference in their entirety.

BACKGROUND OF THE INVENTION

Field of the Invention

The invention relates to a case or a bag having a lid element that can be opened with one hand. The case or bag contains a basic body that is defined by wall elements, a floor element and has an opening that can be closed by a lid element that is disposed on the basic body and can be moved out of an open position into a closed position.

Cases, bags and other storage containers for items have long been known and are commercially available, for example in the form of attaché cases, suitcases and briefcases, as well as bags for video cameras or schoolbags and boxes for suspension files or for laptops and the like.

The problem with the storage containers listed above, which, for the sake of simplicity, are referred to as cases and bags hereinbelow, is that they can usually only be opened with both hands, and, particularly with respect to cases having a hard basic body, for example made of hard plastic or the like, a large amount of space is needed to open them, so the user is not normally able to open the case with one hand, for example during a car journey, in order specifically to remove a desired item from the case with the same hand.

In addition, with respect to attaché cases, which can only be opened from one side, the standing strength of the opened case is very limited because an additional torque is exerted on the case owing to the distance between the side walls and the floor surface when the case is opened, which can easily cause the case to collapse, particularly if heavy items are stored in the opened lid of the case.

Briefcases made of soft material are usually completely lacking in such standing strength, so a solid base, such as a table or chair, is always needed to enable items to be removed from the bag with just one hand.

Finally, other bags made of soft material, such as shoulder bags for video cameras—referred to hereinbelow as camcorder bags—have the problem that they usually have a zip fastener which, in a camcorder bag hung on the shoulder, experience shows can only be opened with two hands, the camcorder bag being held with one hand and the zip fastener being opened with the other, in order then to be able to remove the video camera from the bag. In the same way, it is likewise very awkward and time-consuming putting the video camera back in the bag after use because, to do this, working in the opposite direction, the bag again has to be held with one hand and, after the camera is placed inside, the zip fastener has to be closed with the other.

In this context, a hard-sided case in the form of a pilot case is known from international patent disclosure WO 03/007748 A1, corresponding to U.S. Pat. No. 7,086,511, in which the lid element for closing the case is formed of a number of segments connected together in an articulated manner, which are guided, by their end sections, into associated slide rails disposed on either side of the basic body of the case. Apart from the fact that, because of their articulated connection, the segments tend to become easily jammed in the associated guide rails, it is always necessary, because of the segments used, for the case to have a shape that is rounded in cross section in order to guarantee the smooth and easy operation of the segments. Accordingly, segment construction is unsuitable for use in slim cases, such as briefcases. Furthermore, the construction described offers only limited protection against access from outside because, owing to their small width, the segments have only a very limited rigidity and can therefore easily be pushed out of the guides, giving access to the contents of the case.

SUMMARY OF THE INVENTION

It is accordingly an object of the invention to provide a case or a bag having a lid element that overcomes the above-mentioned disadvantages of the prior art devices of this general type.

With the foregoing and other objects in view there is provided, in accordance with the invention, a case or bag for holding items. The case or bag contains a basic body having wall elements and a floor element. The basic body has an opening formed therein. Interacting guide elements are disposed on the basic body. A lid element for closing the opening is disposed on the basic body. The lid element can be moved out of an open position into a closed position of the opening. The lid element is configured in one piece and has inherent rigidity. The lid element is moved out of the closed position into the open position by the interacting guide elements disposed on the basic body and on the lid element through a combined pivoting and displacing movement.

According to the invention, a case or a bag, which is to be understood as including all of the cases and bags referred to in the introduction to the description, contains a basic body for holding items, which is defined by a floor element and preferably four wall elements connected to the latter. The basic body has here, in a known way, on its side lying opposite the floor element, an opening that can be closed by a lid element that, for this purpose, can be moved out of an open position, in which unobstructed access to the interior of the basic body is possible from outside, into a closed position, in which the lid element closes the opening of the basic body.

The case according to the invention, or the bag according to the invention, is characterized in that the lid element is configured as a shaped body or element with inherent rigidity, which retains its structure if the lid element is moved, in a combined pivoting and displacing movement according to the invention, out of the closed position into the open position and back again along guide elements disposed on the basic body, in particular in the form of guide rails into which slide guide pins disposed in the lid element engage.

In the preferred embodiment of the invention, the guide rails are disposed on the insides of the two lateral wall elements and preferably run directly underneath the edge of the side wall elements, a guide pin or guide roller, which ensures the play-free and easy guiding of the lid element and is disposed on the lower floor-element-side edge of the lid element, and a guide pin or guide roller, which ensures the play-free and easy guiding of the lid element and is disposed on the upper opening-side edge of the lid element, engaging in each guide rail.

The case according to the invention or the bag according to the invention offers the advantage that, owing to the two-point bearing of the lid element in each guide rail irrespective of the chosen shape of the case and lid element, a precise guiding of the lid element is ensured through the combined pivoting and displacing movement, allowing the lid element to pivot away from the basic body over the front wall element of the basic body, giving good access to the interior thereof.

Using the principle underlying the case according to the invention, it is possible, in a case or a bag having wall elements that are disposed upright in relation to the floor element, in particular perpendicular wall elements, to use both a curved, rounded shape and a rectilinear shape for the section between the front wall element and the rear wall element, thus opening up numerous new possibilities for the external configuration of the basic body.

The guide rails can also easily be divided into two partial sections here, where the first partial section of each rail can, for example, extend horizontally, and the second partial section preferably extends along the front wall element, for example vertically.

In the same way, it is possible for the guide rails to be configured to drop away in an arc toward the rear wall element in the area of the side wall elements, so that, for opening the lid element, the latter is first lifted in a kind of lifting movement upward from the opening or away from the floor element and then, in the course of the further movement, pivoted outward away from the rear wall element and at the same time displaced downward toward the floor element.

The kind of combined lifting, pivoting and displacing movement described above offers the advantage that, making optimum use of the space in cases or bags having generally rectangular basic bodies, the opening is also partly accessible from the front in the area of the front wall element—which is preferably lower than the rear wall element here—when the lid element is pushed right down, as a result of which flat items, such as files, brochures or envelopes and the like, contained inside the case can easily be recognized by the writing on the front and do not—as with cases that can only be opened at the top—have to be identified solely by their sometimes narrow edges or spines.

As a result, the flat items desired are therefore, according to the invention, much easier to identify and, because of the partial access through the front, are also much easier to get hold of and remove from the interior of the basic body.

A further advantage of the combined lifting and pivoting movement in connection with a curved or a rectilinear lid element is that the lid element can be provided with lateral projections that extend like wings over the side wall elements in the area of the opening and can preferably join flush with the outsides of the side wall elements, as a result of which the penetration of moisture from above can be prevented very effectively.

In this context, it is also conceivable, owing to the combined lifting and pivoting movement, to arrange, on the inside of the projections, seals that lie on the edges of the side wall elements when the lid element is closed and as a result effectively prevent liquid getting in from outside.

According to a further embodiment of the invention, a section made out of a longitudinally variable material, such as a rubber or textile material or the like folded like bellows, can be inserted between the floor element and the bottom edge, or the lower edge, of the lid element, which material compensates for the change in distance between the floor element and the bottom edge of the lid element arising when the lid element is displaced and pivoted.

Although it is conceivable to fill the area between the floor element and the lower edge of the lid element in the manner described above exclusively by a section of a longitudinally variable material, this area is, in a preferred embodiment of the invention, advantageously closed by a front wall element, likewise made out of a material having inherent rigidity but of smaller surface area, which forms an inherently rigid basic body with the rear wall element, the side wall elements and the floor element, for example made of hard plastic or metal.

According to a further embodiment of the invention, the case according to the invention or the bag according to the invention has a handle that is preferably disposed directly on the lid element so that it can pivot. The advantage of this is that the locking mechanism for locking the lid element to the basic body in the closed position can be configured as a push button that is disposed centrally in the area of the handle and can be actuated ergonomically with one hand.

The push button is preferably positioned here under the handle so that the push button can be pushed toward the handle using one or two fingers of the same hand, which is also used to hold the basic body by the handle.

The advantage of this is that the case or the bag according to the invention can be held by the handle and quickly opened, without changing one's grip, simply by putting the case down on a surface and pulling the lid element down by the handle, in order, with the other hand, to remove a brochure or another item from the interior of the case.

The lid element can then be closed by pulling the handle up, again without changing hands, while, for example, the item or the brochure can easily be held in the other hand.

This advantageous one-handed operation according to the invention of the case according to the invention, which also similarly applies to bags, saves valuable seconds, particularly in sales discussions or product presentations, which are otherwise wasted opening the lid element with two hands, taking the desired item out, putting it down, raising the lid with both hands and closing the lid with both hands.

According to the preferred embodiment of the invention, the locking mechanism contains two angle levers pivotably disposed on the lid element, each having a first and a second arm disposed at an angle of preferably 90°, a tooth-like projection or a lug being provided on the first arm, which, in the closed position, engages into a designated projection or a designated edge of the basic body in order to lock the lid element in the closed position. The second arm of the angle levers interacts here with the preferably displaceable push button, by which the second arm to be displaced is actuated by a compressive force which pivots each of the angle levers about its respective pivot axis and hereby releases the engagement between the tooth-like projection of the respective angle lever and the designated projection or the edge of the basic body, so that the lid element can be displaced along the guides.

In this embodiment of the invention, the second arms of the angle levers preferably engage in designated, in particular rectilinear, recesses in the displaceable push button, which recesses have a slightly greater width than the arms, so that the ends of the second arms can carry out a partial rotational movement in the recesses when the push button is actuated. The push button is actuated here, in particular, by a coil spring having an elastic force, which forces the push button out of an associated guide in the lid, the tooth-like projections on the first arms of the angle levers necessarily also being moved into their engagement position, in order to lock the lid element in the closed position, through the engagement of the second arms into the recesses.

According to a further concept underlying the invention, the lid element can be moved along the guide rails from its closed position into the locked position by use of a motor, and preferably back too, for which purpose an electric drive motor or electromagnet or other drive can be disposed on the basic body or on the lid element, this drive, for example, acting through a rack and a pinion, a toothed belt or some other traction mechanism on the lid element or the locking mechanism.

This embodiment of the invention is particularly advantageous if an electric motor can be activated from outside by remote radio control, so that, to save time, the user of the case can open the lid element from a relatively large distance in order to remove a desired item.

According to a further embodiment of the invention, the basic body, which may be formed, for example, of a rigid plastic material or of metal, particularly aluminum, has closeable compartments for storing items in the area of the rear wall and/or the side walls, which are configured to be foldable or extendable depending on the kind of items to be kept inside. The construction according to the invention advantageously allows the additional holding compartments to be disposed both laterally and in the area of the rear wall or even on the outside of the lid element or in the lid element, which opens up numerous possible configurations and provides ergonomic handling suitable for the respective use of the case or bag.

In order to prevent any unintentional unfolding of the additional storage or holding compartments in the closed position, according to a further embodiment of the invention, it has proved advantageous if the extendable and/or foldable holding compartments are provided with known push-magnet spring-loaded catches, which can be attached to the basic body and, with the aid of a magnet contained therein and a locking mechanism, unlock the closed holding compartment on first pressure applied to the outside of the latter, the respective compartment being moved separately by an elastic force exerted by the magnet out of its closed position into a semi-open position from which it can then be moved by hand into the fully open position. The holding compartment can then be pivoted or displaced by light pressure on its outside back into the closed position in which the locking device contained in the push-magnet spring-loaded catch locks the holding or storage compartment.

According to a further embodiment of the invention, which, in cases having a known, generally square or box-shaped basic body, can also alternatively be used without the lid that is pivotable and displaceable in guides according to the invention, a holding compartment is included in the rear wall of the basic body or else in the side walls thereof, which holding compartment can preferably be pulled out away from the floor element perpendicularly upward from the basic body or the side or rear wall.

The extendable holding compartment, which is particularly suitable for holding pens or business cards, preferably contains an insert which, in the removal position in which the holding compartment is pulled almost completely out of the basic body, can be tilted toward the opening for easier removal of items.

For this purpose, the insert may be disposed pivotably on a rear wall of the extendable holding compartment and, in the removal position, may be supported on an edge or a projection of the basic body or a lateral projection of the holding compartment, which can preferably be guided in corresponding guides disposed in the area of the rear wall of the basic body or on the narrow sides of the holding compartment. As a result, the tilting angle of the insert is limited to a desired degree effectively and by simple measures.

Other features which are considered as characteristic for the invention are set forth in the appended claims.

Although the invention is illustrated and described herein as embodied in a case or a bag having a lid element that can be opened with one hand, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
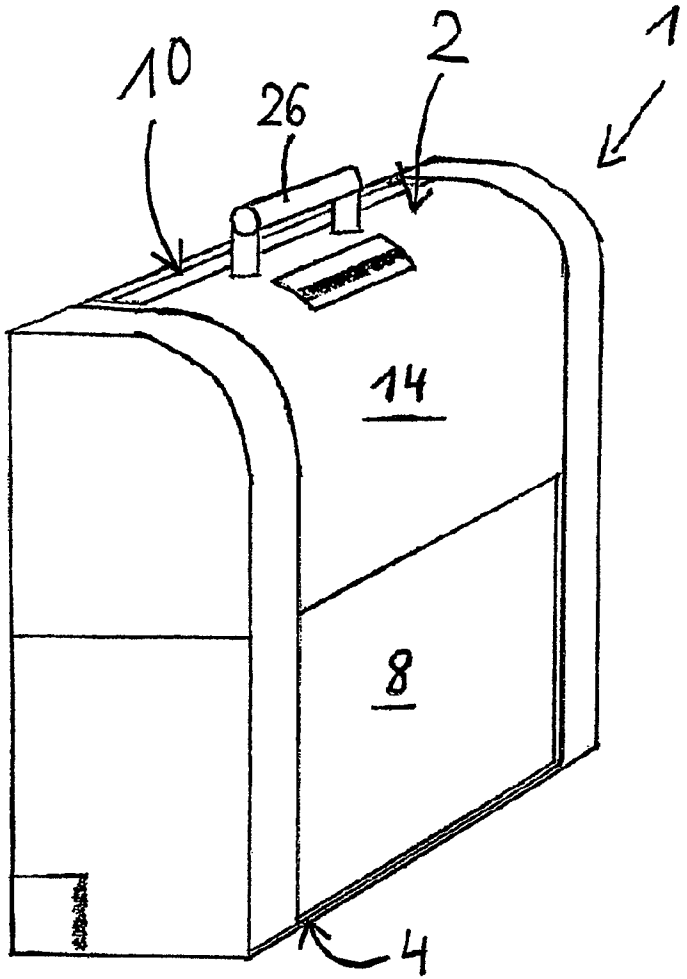
FIG. 1 is a diagrammatic, perspective view of a first embodiment of a case according to the invention with a closed lid element and foldable additional holding compartments disposed on the sidewall elements.
Figure 2:
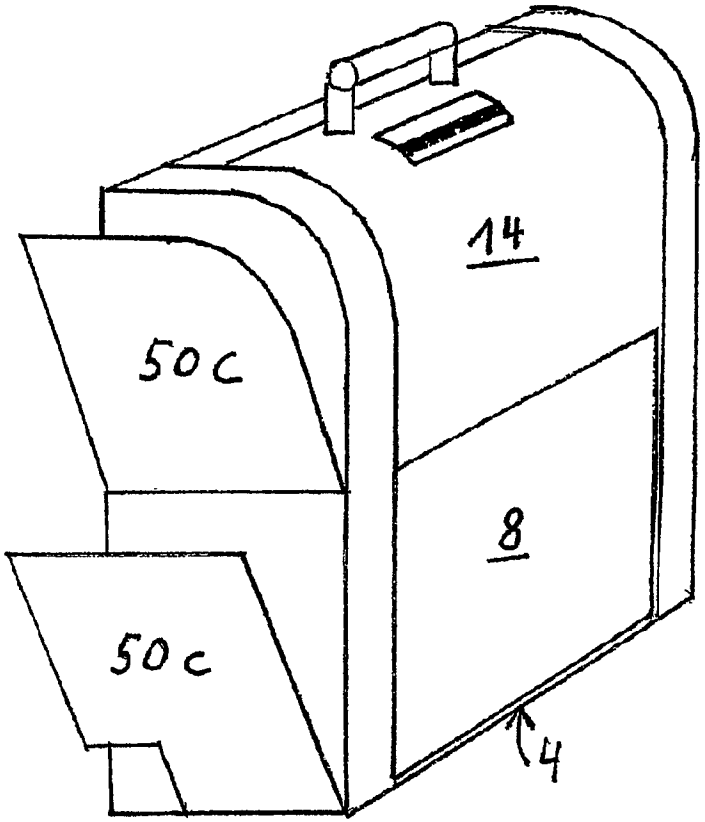
FIG. 2 is a perspective view of the case from FIG. 1, with the holding compartments folded out.

Referring now to the figures of the drawing in detail and first, particularly, to FIGS. 1-9 thereof, there is shown a case or bag 1 according to the invention that is formed of a basic body 2, which has a floor element 4, side wall elements 6*a*, 6*b*, a front wall element 8 and a rear wall element 10.

Figure 4:
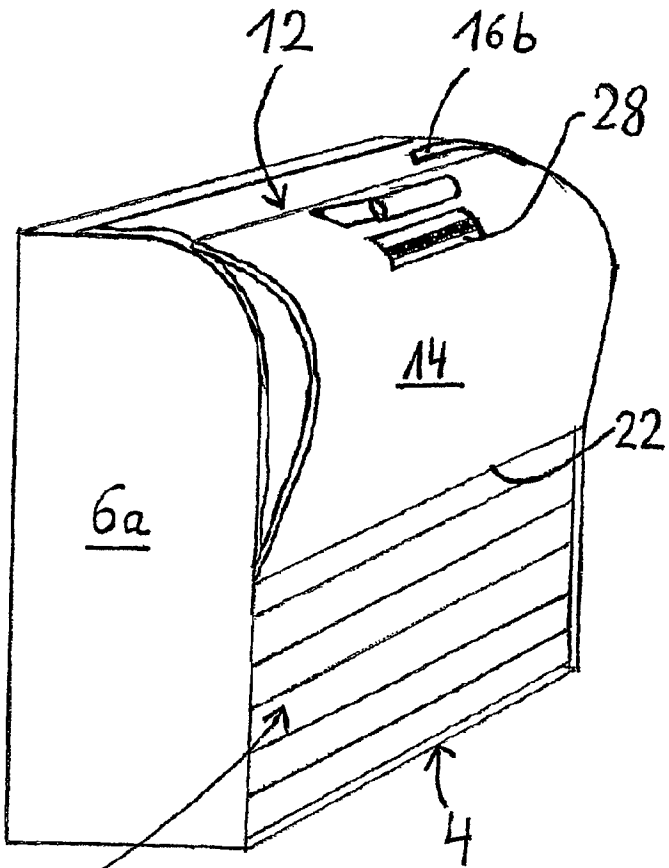
FIG. 4 is a perspective view of the case from FIG. 3, with lid element partially opened.
Figure 7:
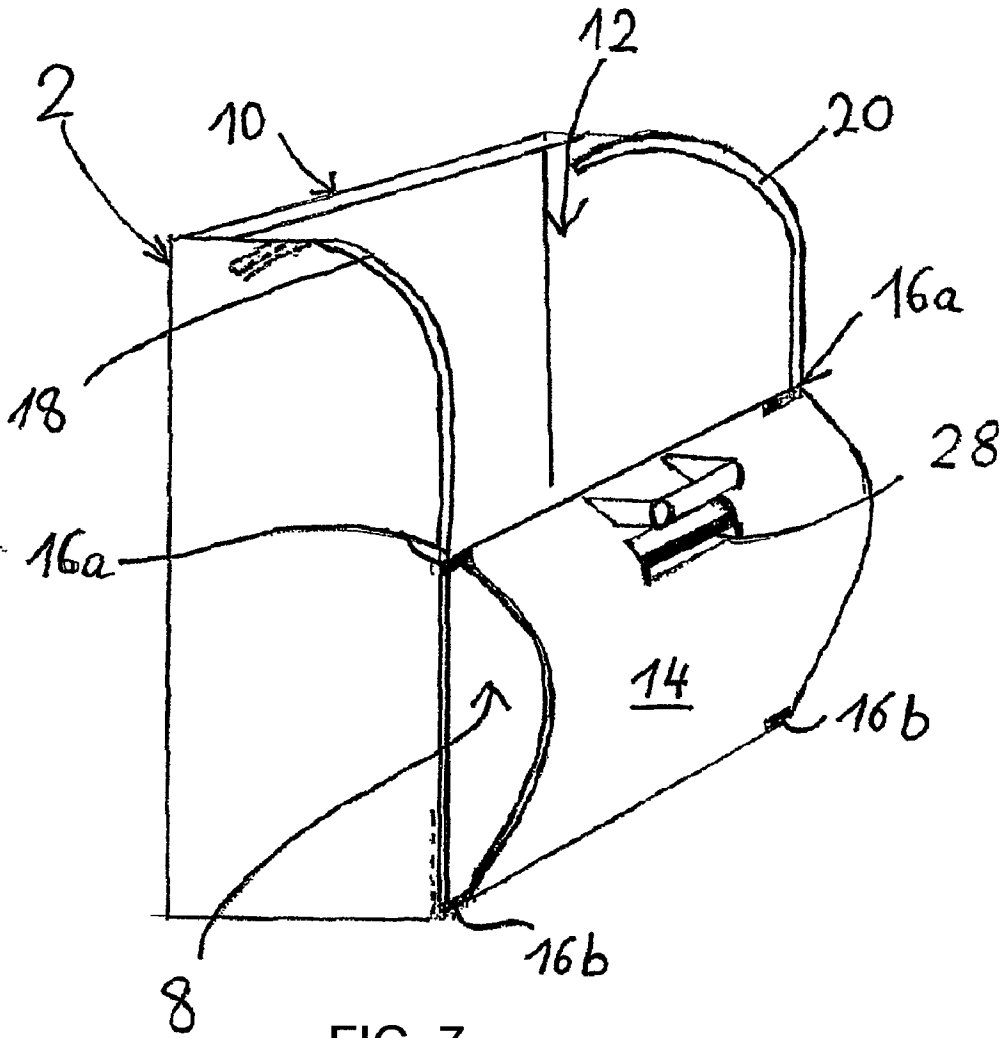
FIG. 7 is a three-dimensional view of the case according to the invention, with lid element pushed right down.
Figure 6:
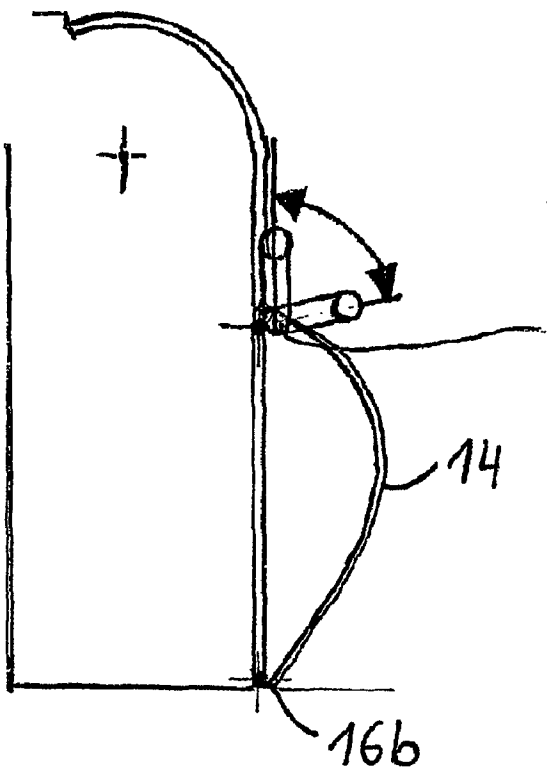
Figure 9:
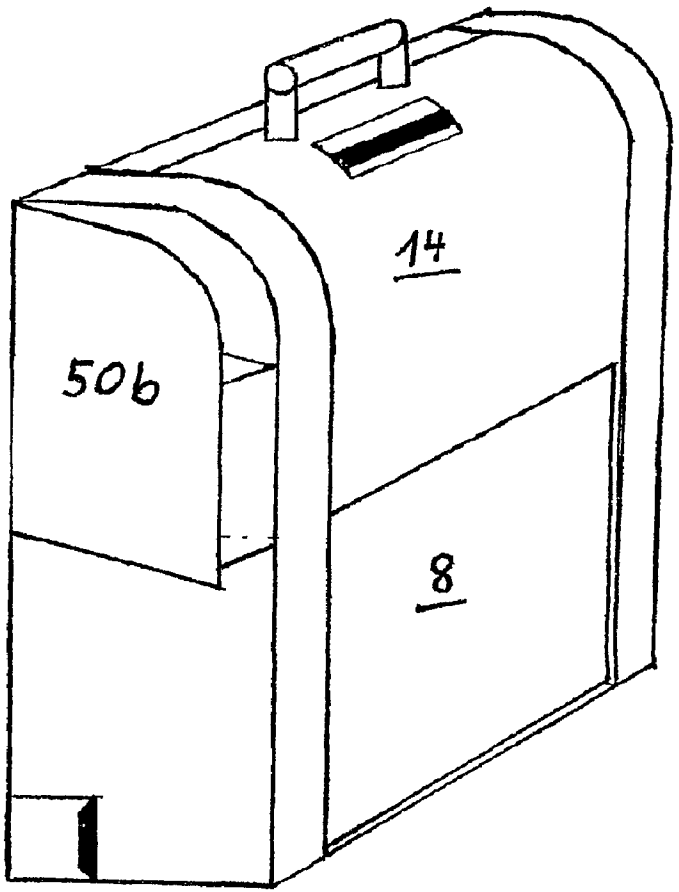
FIG. 9 is a perspective view of a further embodiment of a case according to the invention, having an additional lateral holding compartment pivotable about an axis running perpendicular to the floor element.
Figure 8:
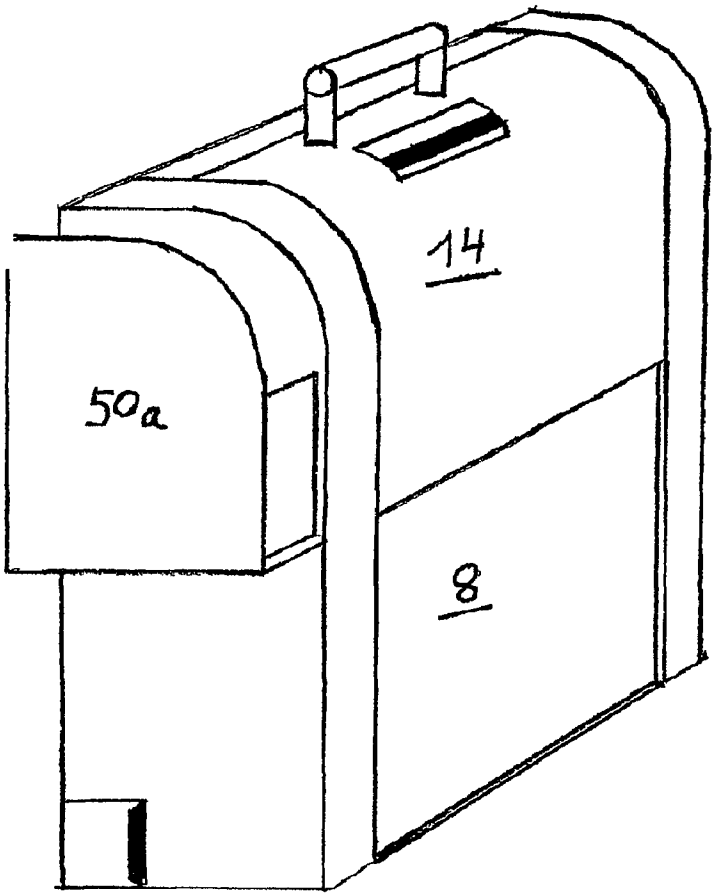
FIG. 8 is a perspective view of a third embodiment of the case according to the invention, in which linearly extendable additional holding compartments are disposed on the side wall elements and a compartment for holding umbrellas is disposed in the area of the floor element and the rear wall element.

As may be seen from the illustration in FIGS. 4 and 7, an opening 12 is made on that side of the basic body 2 opposite the floor element 4, which opening can be closed by an inherently rigid lid element 14. The lid element 14 is guided by lateral upper guide pins 16*a* and lateral lower guide pins 16*b* in lateral guide rails 18, 20 at four points, in order to move the lid element 14, according to the movement path illustrated in FIGS. 5A, 5B, 5C and 6, out of its closed position, in which the lid element 14 completely closes the opening 12, into the open position shown in FIG. 6, in which the opening 12, when the case 1 is standing up, is located both on the top and in the area of the upper part of the front wall element 8 extending to about half the height of the basic body 2.

As a result of the inherently rigid shape of the lid element 14 and the bearing thereof at certain points through the guide journals or guide pins 16*a*, 16*b* in the guide rails 18, 20, the lid element 14 may be of any desired shape that corresponds to the desired shape of the case in the area of the opening, without this limiting the movement of the lid element 14.

According to the illustration in FIG. 7, provision may be made here for the guide rails 18, 20 to extend away from the floor element 4 in an arc starting from the rear wall element 10 in a first partial section, then, in a second partial section, to fall away toward the floor element 4 again according to the arc of the lid element 14, and then, in a third partial section, to pass over, running generallly in a straight line and perpendicular to the floor element 4, in which partial section the guide pins 16*b* generally move in a straight line.

In addition to the arc of the rails 18 and 20 shown, for example, in FIG. 7, provision may also be made for each to contain two rectilinear partial sections disposed, for example, at an angle of 90° or more with respect to one another, which are only connected merely at the bearing point by a third section having a greater curvature which enables the lateral upper guide pins 16*a*, 16*b* to pass from the first partial section to the second partial section.

Figure 3:
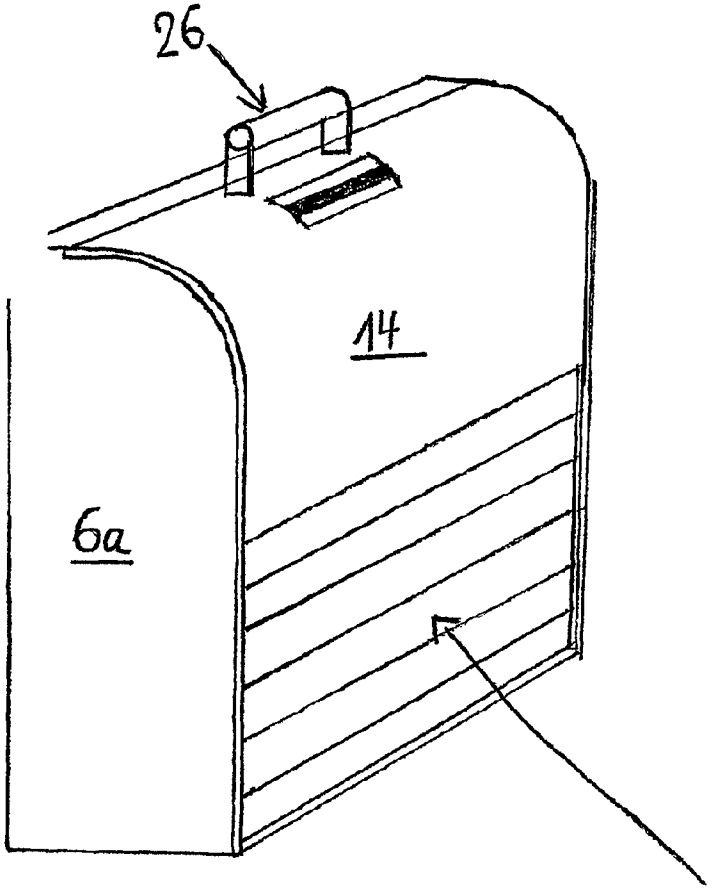
FIG. 3 is a perspective view of a second embodiment of the case according to the invention, in which an area between a lower edge of the lid element and a floor element is covered by a longitudinally variable material.
Figure 5A:
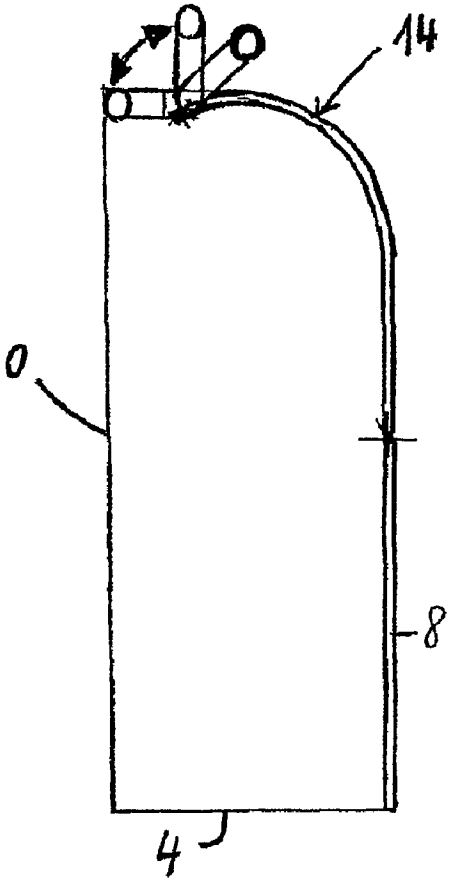
FIGS. 5A and 5B are diagrammatic, cross-sectional side views of the case from FIGS. 1 and 2.
Figure 5B:
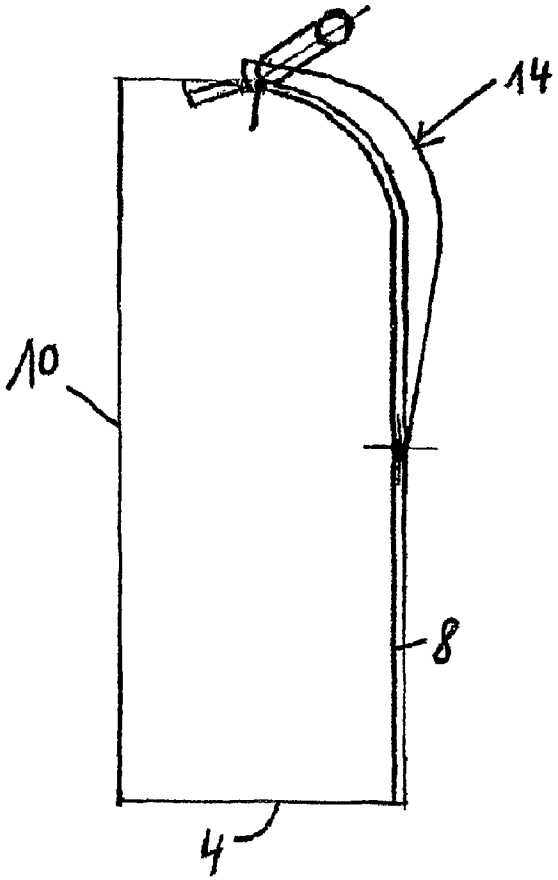
Figure 5C:
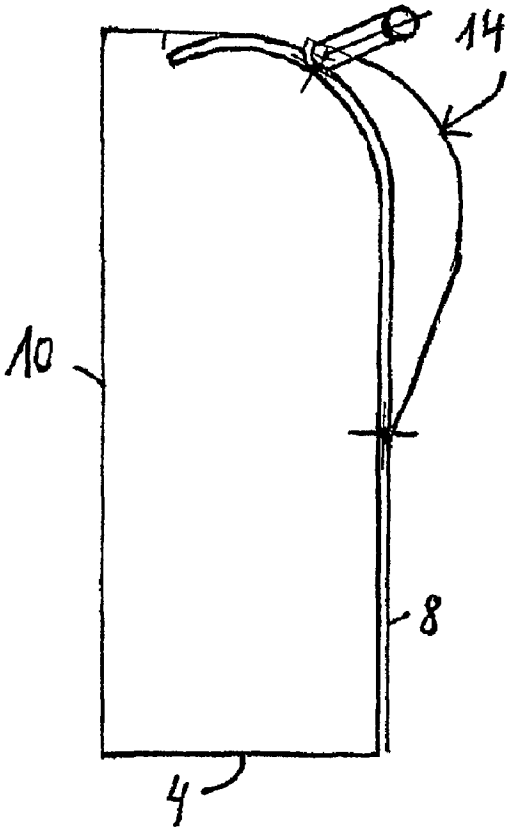
FIGS. 5C and 6 are diagrammatic, cross-sectional side views showing the displacement of the lid element along lateral guide rails disposed in an arc in the upper region in a combined lifting, pivoting and linear displacing movement.

The curved arc-shape of the guide rails falling away toward the rear wall element 10 offers the advantage that the lid element 14 first carries out a lifting movement when moving out of the closed position, which enables the lid element 14, the side wall elements 6*a*, 6*b*—as shown in FIGS. 3 and 4—and/or the rear wall element 10 to extend like wings when moved into the closed position in order to prevent dirt or rain getting in from outside.

In the embodiment of the invention shown in FIGS. 3 and 4, the section between a bottom edge 22 of the lid element 14 and the floor element 4 is filled by a longitudinally variable material 24, such as a textile or rubber material folded like bellows as indicated.

Figure 14:
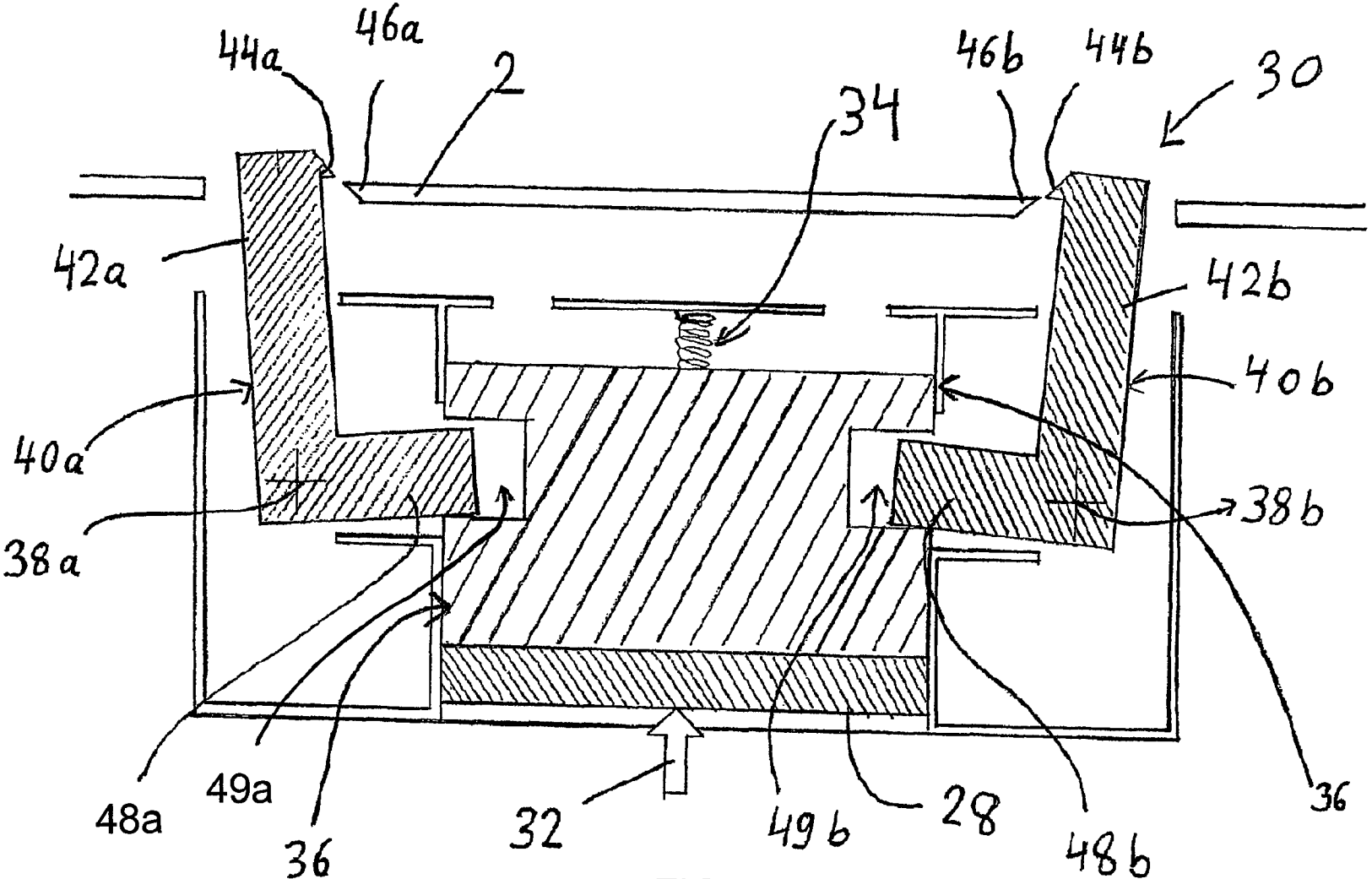
FIG. 14 is a diagrammatic, cross-sectional view through the locking mechanism for locking the lid element in the closed position when the push button is pressed.

According to a further embodiment of the invention, the case or bag 1 according to the invention contains a handle 26, which is preferably disposed pivotably on the lid element 14, and a push button or an actuating element 28 of a locking mechanism 30 is located right next to it, which push button or actuating element 28 is shown in detail in FIG. 14.

The push button 28 is preferably configured here as a longitudinally displaceable bar which is disposed directly under the handle 26 such that the push button 28 can be displaced when holding the case by the handle 26, preferably by two fingers in the direction of the arrow 32 shown in FIG. 14, against the elastic force of a coil spring 34 within its guide 36 in the lid element 14.

The locking mechanism 30 contains here two angle levers 40*a*, 40*b* pivotable about a pivot axis 38*a*, 38*b*, each of which contains a first arm 42*a*, 42*b* on which a tooth-like projection 44*a*, 44*b* is disposed, which, in the closed position, is in engagement with a designated projection or an edge 46*a*, 46*b* of the basic body 2, in order to lock the lid element 14 in the closed position.

As can also be seen in FIG. 14, each of the angle levers 42*a*, 42*b* has a second arm 48*a*, 48*b*, the end of which engages, with a certain play, into a designated rectangular recess 49*a*, 49*b* in the push button 28, so that the angle levers 40*a*, 40*b* are pivoted about their pivot axes 38*a*, 38*b* such that the first arms 42*a*, 42*b* move away from one another if the push button 28 is displaced in the direction of the arrow 32, in order to release the engagement between the tooth-like projections 44*a*, 44*b* and the projections 46*a*, 46*b* on the housing—as shown in FIG. 14—, and unlock the lid element 14.

As can be seen in FIGS. 1, 2, 8, 9 and 11, further holding compartments 50 are preferably disposed on the basic body 14 in the area of the side wall elements 6*a*, 6*b*, which may be configured, for example, as linearly extendable holding compartments 50*a* (FIG. 8) or as holding compartments 50*b* (FIG. 9) pivotable about a pivot axis running perpendicular to the floor element 4 or holding compartments 50*c* (FIG. 2) that can be folded out about a pivot axis running parallel to the floor element 4.

Figure 10B:
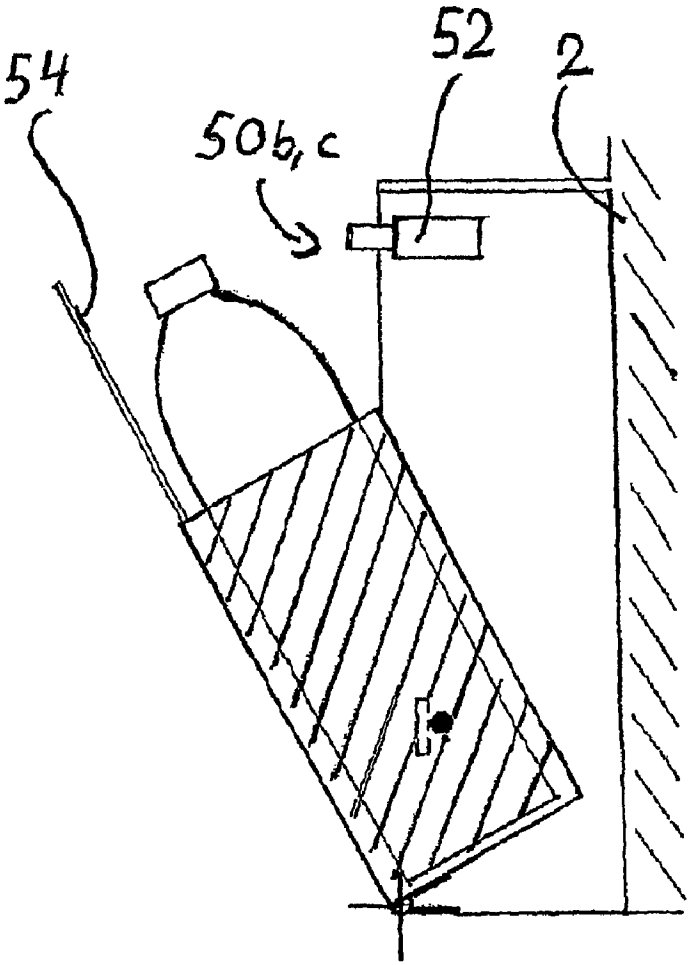
FIG. 10B is a cross-sectional view of the holding compartment from FIG. 10A, in the open position.
Figure 10A:
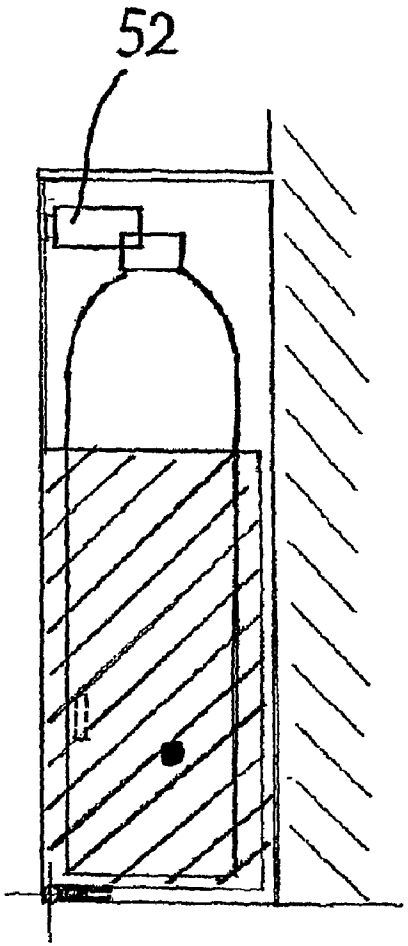
FIG. 10A is a diagrammatic, cross-sectional view through a lateral additional holding compartment according to the embodiment in FIG. 2, having a pivot axis running parallel to the floor element and a drink bottle contained in the holding compartment, to clarify the position and operation of a magnetic spring-loaded catch used to close and lock the additional holding compartments.
Figure 11:
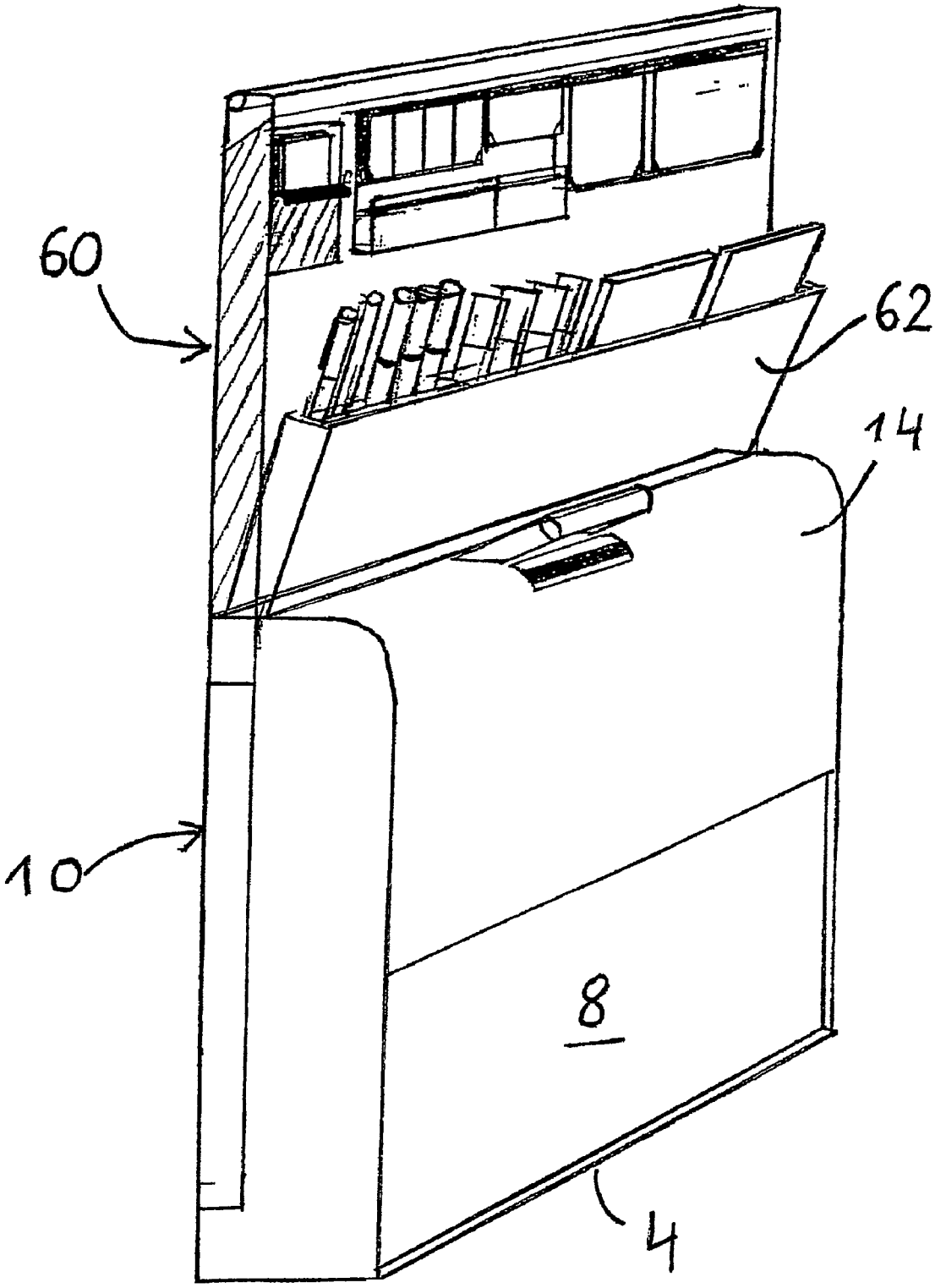
FIG. 11 is a diagrammatic, perspective view of a further embodiment of the case according to the invention, having an additional holding compartment disposed in the area of the rear wall element, extendable upward and having an insert for pens and business cards that is pivoted out toward the lid element.

According to the illustration in FIGS. 10A and 10B, the additional holding compartments 50*a*, 50*b* and 50*c*, in their closed positions, are preferably fixed against unintentional opening by a further locking device, which preferably contain known push-magnet spring-loaded catches 52 attached inside the respective holding compartment 50 on the basic body 2 and interacting with a body made of magnetizable material 54, which is attached to the inside of the lid of the holding compartment (which lid is not shown in any more detail in the figures) and is attracted by the magnet of the push-magnet spring-loaded catch 52. This opens up the possibility of fixing the respective holding compartment 50 in a partially opened intermediate position in which the compartment is held by the magnetic forces of the push-magnet spring-loaded catch so that, if it is unintentionally opened as a result of pressure being applied to the outside of the respective lid of the compartment, the items contained in the compartment stay inside and do not fall out of the compartment. As a result of full pressure being applied to the outside of the holding compartment 50, the push-magnet spring-loaded catch is then fully depressed so that the holding compartment is fully closed, and—as shown, for example, in FIG. 1—comes down flush and level with the outside of the case.

Figure 12A:
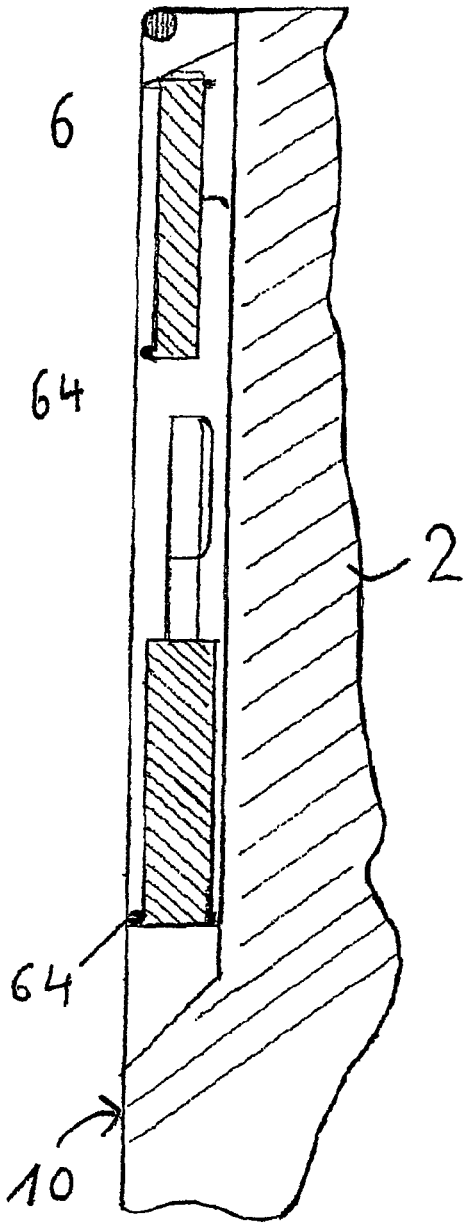
FIG. 12A is a cross-sectional view of the embodiment in FIG. 11 in the area of the rear wall element with the holding compartment closed.
Figure 12B:
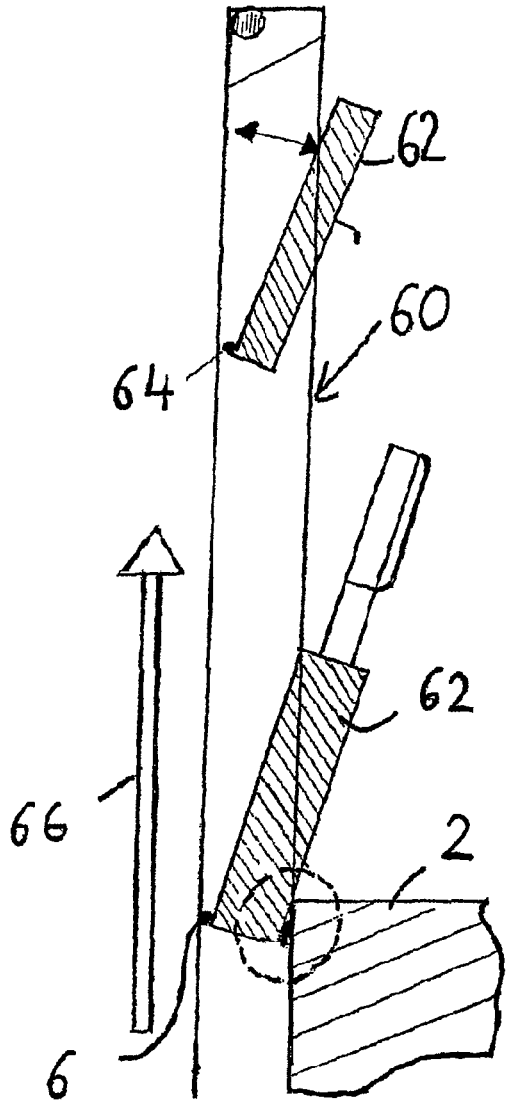
FIG. 12B is a cross-sectional view through the extendable holding compartment in the open position, having two removal compartments disposed in a tilted position.

As is shown in FIGS. 11, 12A, 12B and 13, according to a further embodiment of the invention, which is particularly preferably used in combination with the lid element 14 described above and disposed pivotably and displaceably in guide rails, a holding compartment 60 that is generally linearly extendable away from the floor element 4 can be provided in the rear wall or in the rear wall element 10, which compartment has one or more inserts 62 for pens, business cards or the like, which inserts can be pivoted or tilted about pivot axes 64 within the extendable holding compartment 60, and, after the compartment 60 has been pulled out of the basic body 2 in the direction of the arrow 66 in FIG. 12B, are inclined toward the lid element 14 to make it easier to remove the items contained in the insert 62.

Figure 13:
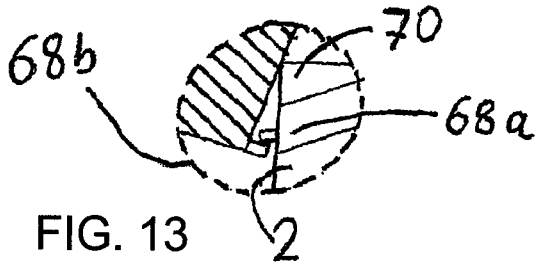
FIG. 13 an enlarged illustration of a projection disposed on the insert in FIGS. 12A and 12B and of an extraction limitation.

According to the illustration in FIG. 13, a projection 68*a* can be provided in the area of the rear wall element 10, which projection interacts with a further projection 68*b* in order to move the insert 62 in the end position automatically into the tilted position shown in FIG. 12B and limit the tilting angle of the insert. In the same way, however, the insert 62 can also bear on an edge or on a projection 70 of the basic body 2.

The invention claimed is:

1. A case or bag for holding items, comprising:

a basic body having wall elements and a floor element, said basic body having an opening formed therein, said wall elements including a front wall element running generally perpendicular to said floor element, a rear wall element opposite said front wall element, and two side wall elements, which combined define said basic body;

interacting guide elements disposed on said basic body;

a lid element for closing said opening and disposed on said basic body, said lid element movable out of an open position into a closed position of said opening, in the closed position, said lid element extending like a wing over said side wall elements, said lid element having an arched cross-section and being configured in one piece and having inherent rigidity, said lid element being moved out of the closed position into the open position by said interacting guide elements disposed on said basic body and on said lid element through a combined pivoting and displacing movement;

said interacting guide elements having two guide rails disposed on said basic body such that only one guide rail is disposed on each side wall element of the two side wall elements and at least two guide pins or rollers disposed on each side of said lid element facing a side wall element, said at least two guide pins or rollers on each side of said lid element engaging said only one guide rail on the facing side wall element of said basic body to guide said lid element during the combined pivoting and displacing movement; and said front wall element being lower than said rear wall element, and said opening that can be closed by said lid element extending from said front wall element to said rear wall element.

2. The case or bag according to claim 1, wherein each of said guide rails has a first and second partial section.

3. The case or bag according to claim 1, wherein said front wall element has a section made out of a longitudinally variable material.

4. The case or bag according to claim 1, further comprising a handle disposed on said lid element for moving said lid element and carrying the case or bag.

5. The case or bag according to claim 4, further comprising a locking mechanism for locking said lid element in the closed position, said locking mechanism having a central movable push button that can be operated with one hand.

6. The case or bag according to claim 5, wherein said push button is disposed directly under said handle and said basic body can be gripped by said handle using one hand and said push button can then be operated using the same hand.

7. The case or bag according to claim 5, wherein:

said basic body has designated projections; and said locking mechanism has two angle levers pivotably disposed on said lid element, said angle levers having first arms each with a tooth-shaped projection which, in the closed position, engage said designated projections on said basic body, said angle levers have second arms actuated by said push button by a compressive force pivoting said angle levers if said push button is displaced relative to said lid element.

8. The case or bag according to claim 7, wherein:

said push button has designated recesses formed therein; and said second arms of said angle levers engage in said designated recesses in said push button, and said push button is actuated by an elastic device having an elastic force which displaces said push button such that said tooth-shaped projections of said angle levers are in engagement with said designated projections of said basic body to lock said lid element in the closed position.

9. The case or bag according to claim 1, wherein said lid element can be moved from the closed position into a locked position by a motor.

10. The case or bag according to claim 1, wherein said basic body has closable compartments for storing items, said closable compartments disposed in an area of at least one of said rear wall element and said side wall elements, said closable compartments can be moved from a closed position into a removal position.

11. The case or bag according to claim 10, wherein said closable compartments are built foldably or displaceably into said side wall elements.

12. The case or bag according to claim 10, further comprising spring-loaded catches disposed on said basic body for locking said closable compartments in the closed position.

13. The case or bag according to claim 10, further comprising an extendable holding compartment being extendable away from said floor element toward said opening in said basic body, is disposed in said rear wall element.

14. The case or bag according to claim 13, wherein said extendable holding compartment has an insert which can be tilted toward said lid element for easy removal of items in a removal position.

15. The case or bag according to claim 14, wherein:

said basic body has a projection; and when tilted, said insert is supported on said projection of said basic body to limit a tilting angle of said insert.

16. The case or bag according to claim 15, wherein:

said basic body has a first projection; and said insert has a second projection, said insert automatically moves into a tilted end position as a result of said first projection interacting with said second projection.

17. The case or bag according to claim 1, wherein said side wall elements have projections and in the closed position, said lid element extends like a wing over said projections disposed on the side wall elements.

18. The case or bag according to claim 13, wherein said extendable holding compartment is provided for holding pens.

19. The case or bag according to claim 13, wherein said insert is provided for holding business cards and pens.

* * * * *